US010117528B2

(12) United States Patent
Collette

(10) Patent No.: US 10,117,528 B2
(45) Date of Patent: Nov. 6, 2018

(54) METHOD OF USING SHELF DIVIDER SYSTEM

(71) Applicant: Post Consumer Brands, LLC, Lakeville, MN (US)

(72) Inventor: Stephen Robert Collette, Lakeville, MN (US)

(73) Assignee: POST CONSUMER BRANDS, LLC, Lakeville, MN (US)

( * ) Notice: Subject to any disclaimer, the term of this patent is extended or adjusted under 35 U.S.C. 154(b) by 0 days.

(21) Appl. No.: 15/882,474

(22) Filed: Jan. 29, 2018

(65) Prior Publication Data

US 2018/0146802 A1 May 31, 2018

Related U.S. Application Data

(63) Continuation of application No. 15/146,349, filed on May 4, 2016.

(51) Int. Cl.
*A47F 5/00* (2006.01)
*A47F 5/10* (2006.01)
(Continued)

(52) U.S. Cl.
CPC ..... *A47F 5/005* (2013.01); *A47F 5/105* (2013.01); *A47F 7/0071* (2013.01); *A47F 7/281* (2013.01); *G09F 3/204* (2013.01)

(58) Field of Classification Search
CPC ..... A47F 5/005; A47F 5/105; A47F 7/281; A47F 7/0071; G09F 3/204; A47B 57/58; A47B 96/04; B65D 25/04
(Continued)

(56) References Cited

U.S. PATENT DOCUMENTS 487,421 A 12/1892 Lindberg
551,642 A * 12/1895 Kleine ..... B41K 1/54 101/333
(Continued)

FOREIGN PATENT DOCUMENTS

CN 3229435 D 3/2002
CN 2547230 Y 4/2003
(Continued)

OTHER PUBLICATIONS

Declaration of Huijie Shao in Support of Defendants' Opposition to Plaintiffs' Motion for Preliminary Injunction (with exhibits), Case No. 17-cv-04915-JNE-TNL, dated Nov. 17, 2017, pp. 1-127.
(Continued)

*Primary Examiner* — Jonathan Liu
*Assistant Examiner* — Devin K Barnett
(74) *Attorney, Agent, or Firm* — Thompson Coburn LLP

(57) ABSTRACT

First and second shelf partitions for containing and displaying bagged food on point-of-sale shelving are accessed. Each shelf partition has a front panel and an adjustable length side panel. The first partition is attached to the shelf such that the front panel is adjacent to an aisle facing side the shelf and a rearward edge of the adjustable side panel is adjacent to a rear side of the shelf. The second shelf partition is attached to the shelf such that the front panel is adjacent to the rear side of the shelf and the rearward edge of the adjustable side panel is adjacent to the aisle facing side of the shelf. The second partition is spaced from the first partition a distance to accommodate placing bagged food on the shelf between the side panels of the first and second partitions and partially behind the first partition front panel.

14 Claims, 4 Drawing Sheets

(51) Int. Cl.
*A47F 7/00* (2006.01)
*A47F 7/28* (2006.01)
*G09F 3/20* (2006.01)

(58) Field of Classification Search
USPC ..... 211/184; 108/27, 60, 61; 220/551, 529, 220/532, 533; D6/706
See application file for complete search history.

(56) References Cited

U.S. PATENT DOCUMENTS 560,893 A * 5/1896 Conant ..... B62D 33/0273 160/217
1,688,003 A * 10/1928 Darby ..... A47F 5/005 211/10
1,714,266 A * 5/1929 Johnson ..... A47L 19/02 211/184
1,750,576 A 3/1930 Cubberley
1,919,568 A * 7/1933 McCosh ..... A47B 88/90 217/7
1,952,749 A * 3/1934 Ellis ..... A47B 13/06 108/27
2,082,667 A * 6/1937 Vanderveld ..... A47B 88/90 206/558
2,118,444 A * 5/1938 Mueller ..... A47F 5/005 211/131.1
2,148,681 A * 2/1939 Cameron ..... A01K 41/065 119/322
2,197,789 A * 4/1940 Dalton ..... A47F 5/10 211/184
2,222,974 A * 11/1940 Wilson ..... A47F 5/00 119/416
D150,315 S 7/1948 Richards
2,471,977 A * 5/1949 Power ..... A47C 21/00 211/184
2,516,122 A 7/1950 Hughes
D163,536 S 6/1951 Morris
2,586,925 A * 2/1952 Drengberg ..... B42F 17/02 220/533
2,658,628 A * 11/1953 Hilgen ..... A47B 57/58 211/184
2,743,774 A * 5/1956 Pinto ..... A47B 88/90 160/216
2,845,188 A * 7/1958 Rosenquist ..... A47B 57/58 211/184
2,872,046 A 2/1959 Polay
2,943,742 A 7/1960 Colley
3,002,632 A 10/1961 Van
D194,425 S 1/1963 Hungerford
3,117,535 A * 1/1964 Hendrickson ..... A47B 41/00 108/185
D199,794 S 12/1964 Lindley
3,301,408 A * 1/1967 Craine ..... A47B 57/586 211/184
3,304,142 A * 2/1967 Rockola ..... G07F 9/10 211/184
3,308,964 A * 3/1967 Pistone ..... A47B 57/586 108/61
3,329,928 A 7/1967 Broske
3,410,445 A * 11/1968 Pilley ..... A47B 88/90 220/533
3,468,426 A 9/1969 Loewy
3,491,909 A * 1/1970 Ikelheimer ..... A45C 13/02 190/109
3,521,808 A 7/1970 Weiss
3,559,815 A * 2/1971 Huddleston ..... A47F 5/005 211/184
3,592,344 A 7/1971 Schade
3,692,191 A * 9/1972 Moore ..... A47B 57/585 211/184
D234,075 S 1/1975 Clark
D236,935 S 9/1975 Frazelle
3,954,184 A * 5/1976 Mendenhall ..... A47F 5/005 211/184
D241,295 S 9/1976 Entin
D242,198 S 11/1976 Geisler
D246,303 S 11/1977 Davis
D246,304 S 11/1977 Horn
4,111,307 A 9/1978 Peggs
D252,436 S * 7/1979 Elliott ..... D6/706
4,178,047 A 12/1979 Welch
D267,668 S 1/1983 Rambusch et al.
4,395,955 A * 8/1983 Pfeifer ..... A47F 5/005 108/61
D272,161 S 1/1984 Lodge et al.
D274,491 S 7/1984 Lietzke
D275,921 S 10/1984 Ward
4,491,137 A 1/1985 Jingu
D279,151 S 6/1985 Weiller
4,595,105 A * 6/1986 Gold ..... A47B 65/00 108/60
D285,152 S * 8/1986 Smith ..... D19/34.1
4,618,063 A * 10/1986 Mendenhall ..... A47F 5/005 211/184
4,712,694 A * 12/1987 Breslow ..... A47F 5/005 108/61
4,716,841 A 1/1988 Suttles
4,762,235 A 8/1988 Howard et al.
4,765,492 A 8/1988 Howard et al.
4,768,661 A * 9/1988 Pfeifer ..... A47F 5/005 211/184
4,792,051 A * 12/1988 Miller ..... A47F 5/005 108/61
4,858,774 A * 8/1989 Winter ..... A47B 96/04 108/61
D303,458 S 9/1989 Zapf
4,889,253 A * 12/1989 Schmulian ..... A45C 13/02 220/551
4,889,397 A * 12/1989 Ryan ..... A47B 57/58 108/60
D305,582 S 1/1990 Zapf
4,898,354 A * 2/1990 Whittington ..... A47B 57/585 211/175
D306,670 S 3/1990 Pfleuger et al.
4,905,847 A * 3/1990 Hanson ..... A47B 57/58 211/184
D308,394 S * 6/1990 Smith ..... D19/34.1
D311,469 S 10/1990 Miller
5,024,336 A * 6/1991 Spanner ..... A47F 3/14 211/153
D318,769 S 8/1991 Marchiony et al.
5,073,428 A 12/1991 Lancelot et al.
D327,190 S 6/1992 Wear et al.
D328,539 S 8/1992 Waterston
5,148,927 A * 9/1992 Gebka ..... A47F 5/005 108/60
D333,934 S 3/1993 Ozawa
D336,933 S 6/1993 Sharon et al.
5,341,945 A * 8/1994 Gibson ..... A47F 5/005 108/60
D351,524 S 10/1994 Belokin, Jr.
5,432,391 A 7/1995 Zawoysky
D365,933 S 1/1996 Spielvogel
D369,700 S 5/1996 Sandy
5,582,305 A * 12/1996 Howell, Sr. ..... A47F 5/0006 211/126.1
D386,335 S 11/1997 LaFreniere
5,682,824 A * 11/1997 Visk ..... A47F 5/005 108/60
5,685,664 A * 11/1997 Parham ..... A47F 1/126 211/59.3
5,695,077 A * 12/1997 Jay ..... A47F 1/12 211/175
D393,005 S 3/1998 Devito
5,803,276 A * 9/1998 Vogler ..... A47F 5/005 108/60
5,855,281 A 1/1999 Rabas
5,926,315 A 7/1999 McBride

(56) References Cited

U.S. PATENT DOCUMENTS 6,041,720 A * 3/2000 Hardy ..... A47B 96/02 108/60
6,073,794 A * 6/2000 Bidot ..... A47B 88/90 220/529
6,142,316 A * 11/2000 Harbour ..... A47F 1/12 211/59.2
6,161,320 A 12/2000 Peterson
6,164,215 A * 12/2000 Cook ..... A47B 96/04 108/60
D436,772 S 1/2001 Soderstrom
D439,084 S 3/2001 Schacht et al.
D443,895 S 6/2001 Pfanner et al.
D445,019 S 7/2001 Vitetta
D445,615 S 7/2001 Burke
6,276,538 B1 8/2001 Battaglia et al.
6,325,221 B2 12/2001 Parham
D453,161 S 1/2002 Pentz
6,341,755 B1 1/2002 Kump
D457,737 S 5/2002 Citterio
D458,781 S 6/2002 Cook et al.
D470,684 S 2/2003 Beauregard
6,533,131 B2 3/2003 Bada
D473,080 S * 4/2003 Kellogg ..... D6/706
D479,930 S 9/2003 Cook et al.
6,685,037 B1 2/2004 Zadak
6,691,891 B2 2/2004 Maldonado
D490,103 S 5/2004 Rangel et al.
D494,394 S 8/2004 Leong-Son et al.
D495,172 S 8/2004 Brownfield et al.
D495,539 S 9/2004 Sjoberg
D505,809 S 6/2005 Cassidy et al.
D507,915 S * 8/2005 Nagel ..... D6/706
D511,060 S 11/2005 Linden
6,991,307 B2 1/2006 Hoenig
7,066,563 B2 * 6/2006 Berger ..... A47B 88/90 312/205
7,083,054 B2 * 8/2006 Squitieri ..... A47F 1/12 211/184
7,163,119 B2 1/2007 Besselman
D551,294 S * 9/2007 Goudy ..... D19/34.1
D553,384 S 10/2007 Wilenius
D554,912 S 11/2007 Scicluna et al.
D564,764 S 3/2008 Springer et al.
D566,760 S 4/2008 Cristofaro
D568,645 S 5/2008 Gore et al.
D569,141 S * 5/2008 Tobias ..... D6/706
D585,215 S 1/2009 Rosenberg
7,478,731 B1 * 1/2009 Mason ..... A47F 1/126 211/59.3
D587,939 S 3/2009 Schloss
D594,313 S 6/2009 Clarke
D596,431 S * 7/2009 Berger ..... D6/706
7,703,866 B2 * 4/2010 Benz ..... F25D 25/02 211/184
D615,919 S 5/2010 Bock
D617,125 S * 6/2010 Erickson ..... D6/706
7,726,057 B2 * 6/2010 Brinkman ..... G09F 3/204 248/220.21
D619,393 S 7/2010 Golias et al.
D630,087 S 1/2011 Stram et al.
D635,379 S 4/2011 Klein et al.
D650,596 S 12/2011 Thompson
D651,416 S 1/2012 Martin et al.
8,096,427 B2 1/2012 Hardy
8,113,360 B2 * 2/2012 Olson ..... A47F 1/125 211/59.3
D657,421 S 4/2012 Yan
D658,497 S 5/2012 Paschke et al.
D661,112 S 6/2012 Grandin et al.
D661,519 S 6/2012 James et al.
D665,196 S 8/2012 Plikat et al.
8,276,766 B2 10/2012 Rataiczak, III et al.
D673,216 S 12/2012 Yuan
D674,216 S * 1/2013 Erickson ..... D6/683.1
8,342,340 B2 1/2013 Rataiczak, III et al.
D679,329 S 4/2013 Stravitz
8,454,262 B2 * 6/2013 Norman ..... B65D 13/04 220/532
D690,118 S 9/2013 Grandin et al.
D690,139 S 9/2013 Trinh et al.
D691,402 S 10/2013 Parker
8,556,092 B2 10/2013 Valiulis et al.
D699,990 S 2/2014 Martell et al.
D702,068 S * 4/2014 Mitten ..... D6/706
D703,744 S 4/2014 Pennaz et al.
D717,370 S 11/2014 Hammer
D717,573 S 11/2014 Fishman et al.
D723,842 S 3/2015 Walker
D726,256 S 4/2015 Thomson et al.
D726,463 S 4/2015 Andersson
D727,638 S 4/2015 Tsuchiyama et al.
D730,662 S 6/2015 Trinh et al.
9,090,195 B2 * 7/2015 Peters ..... B60P 7/14
9,138,075 B2 * 9/2015 Hardy ..... A47F 1/126
9,173,504 B2 * 11/2015 Hardy ..... A47F 1/126
D754,251 S 4/2016 Bigham et al.
D760,519 S 7/2016 Le
D761,369 S 7/2016 Elsea et al.
9,392,884 B2 * 7/2016 Juric ..... A47F 1/126
D766,023 S * 9/2016 Coretti, Jr. ..... D6/705
D773,219 S * 12/2016 Clouse ..... D6/705
D776,298 S 1/2017 Melin
9,538,860 B2 * 1/2017 Brej ..... A47F 1/126
9,549,623 B1 * 1/2017 Snell ..... A47B 88/975
D779,865 S 2/2017 Bram
9,591,923 B2 3/2017 Zeidner et al.
D784,746 S 4/2017 Jackson
D784,747 S 4/2017 Jackson
9,642,475 B2 5/2017 Vogler et al.
D791,524 S * 7/2017 Collette ..... D6/706
D792,137 S * 7/2017 Collette ..... D6/706
9,723,934 B2 * 8/2017 Hardy ..... A47B 73/006
D798,091 S * 9/2017 Collette ..... D6/706
D800,485 S * 10/2017 Boni ..... D6/705
D803,601 S 11/2017 Schalk et al.
D808,206 S * 1/2018 Zeidner ..... D6/706
9,895,007 B2 * 2/2018 Hardy ..... A47F 1/126
D811,759 S 3/2018 Woods
D814,216 S 4/2018 French et al.
D815,690 S 4/2018 Squillante
2001/0002659 A1 * 6/2001 Bada ..... A47B 57/583 211/59.2
2003/0010737 A1 * 1/2003 Lee ..... A47F 3/147 211/184
2003/0132178 A1 * 7/2003 Jay ..... A47B 96/021 211/59.2
2003/0137227 A1 * 7/2003 Hoenig ..... A47B 88/90 312/348.3
2003/0189018 A1 10/2003 Hopkins et al.
2004/0011754 A1 * 1/2004 Zadak ..... A47B 57/58 211/184
2004/0188444 A1 * 9/2004 Besselman ..... A47B 96/04 220/551
2004/0211739 A1 10/2004 Lembe
2005/0150847 A1 * 7/2005 Hawkinson ..... A47F 5/005 211/59.2
2005/0178696 A1 8/2005 Van Diepen
2006/0049125 A1 * 3/2006 Stowell ..... A47B 57/583 211/184
2006/0075670 A1 * 4/2006 Brinkman ..... G09F 3/204 40/666
2007/0175844 A1 * 8/2007 Schneider ..... A47F 5/005 211/184
2009/0159763 A1 6/2009 Kim
2010/0252519 A1 * 10/2010 Hanners ..... A47F 5/005 211/184
2011/0174750 A1 7/2011 Poulokefalos
2012/0031865 A1 * 2/2012 Paeth ..... A47B 57/588 211/134
2012/0111764 A1 * 5/2012 Lackey ..... A47F 5/005 206/736

(56) References Cited

U.S. PATENT DOCUMENTS

| | | | | |
|---|---|---|---|---|
| 2012/0175327 | A1* | 7/2012 | Weiher | A47B 65/00 211/71.01 |
| 2013/0020270 | A1* | 1/2013 | Valiulis | A47F 5/005 211/59.2 |
| 2013/0112640 | A1* | 5/2013 | Desmond | A47B 96/021 211/153 |
| 2014/0151313 | A1* | 6/2014 | Breslow | A47F 1/04 211/59.3 |
| 2014/0210331 | A1* | 7/2014 | Tunzi | F25D 25/00 312/404 |
| 2015/0041418 | A1 | 2/2015 | Grubbs et al. | |
| 2015/0225122 | A1* | 8/2015 | Jones | B43M 99/008 220/533 |
| 2015/0359358 | A1* | 12/2015 | Miller, Jr. | A47F 5/005 211/59.2 |
| 2016/0029794 | A1 | 2/2016 | Obitts et al. | |
| 2016/0073776 | A1* | 3/2016 | Zeidner | A47B 57/588 211/134 |
| 2016/0242573 | A1* | 8/2016 | Colelman | A47F 5/005 |
| 2017/0196355 | A1* | 7/2017 | Hardy | A47B 57/588 |
| 2017/0258248 | A1 | 9/2017 | Walker | |
| 2017/0291555 | A1 | 10/2017 | Keezer | |
| 2017/0318985 | A1* | 11/2017 | Collette | A47F 5/005 |
| 2018/0020830 | A1* | 1/2018 | Leinonen | A47B 57/585 |

FOREIGN PATENT DOCUMENTS

| | | | |
|---|---|---|---|
| CN | 3292377 | D | 5/2003 |
| CN | 3292378 | D | 5/2003 |
| CN | 3292379 | D | 5/2003 |
| CN | 3323544 | D | 9/2003 |
| CN | 2588875 | Y | 12/2003 |
| DE | 40210086-0001 | | 5/2003 |
| DE | 40210086-0002 | | 5/2003 |
| DE | 40210086-0005 | | 5/2003 |
| JP | 2015-128559 | A | 7/2015 |
| TW | D133117 | | 1/2010 |
| TW | M450299 | U | 4/2013 |

OTHER PUBLICATIONS

Declaration of Stephanie Nelson in Support of General Mills, Inc. and General Mills Sales, Inc.'s Opposition to Plantiff's Preliminary Injunction (with exhibits), Case No. 17-cv-04915-JNE-TNL, dated Nov. 17, 2017, pp. 1-202.

Declaration of Yun (Louise) Lu in Support of Defendants' Opposition to Plaintiffs' Motion for Preliminary Injunction (with exhibits), Case No. 17-cv-04915-JNE-TNL, dated Nov. 16, 2017, pp. 1-92.

Defendants' Preliminary Invalidity Contentions, Case No. 17-cv-04915-JNE-TNL, dated Nov. 8, 2017, pp. 1-22.

Defendants' Preliminary Non-Infringement Contentions, Case No. 17-cv-04915-JNE-TNL, dated Nov. 8, 2017, pp. 1-13.

Memorandum re Post Consumer Brands, LLC motion for preliminary injunction and memorandum to unseal motion, United States District Court of Minnesota, Case No. 17-cv-04915-JNE-TNL, dated Dec. 7, 2017, pp. 1-13.

Design U.S. Appl. No. 29/617,480, filed Sep. 14, 2017.

Affidavit of Richard Nathan in Support of General Mills, Inc. and General Mills Sales, Inc.'s Brief (with exhibits), Case No. 17-cv-04915-JNE-TNL, 2017, pp. 1-33.

Defendants' Opposition to Plaintiff's Motion for Preliminary Injunction, Case No. 17-cv-04915-JNE-TNL, dated Nov. 17, 2017, pp. 1-75.

Declaration of Shane Obitts (with exhibits), Case No. 17-cv-04915-JNE-TNL, dated Nov. 17, 2017, pp. 1-10.

Declaration of Rob Naumoski in Support of General Mills, Inc. and General Mills Sales, Inc.'s Memorandum (with exhibits), Case No. 17-cv-04915-JNE-TNL, dated Nov. 16, 2017, pp. 1-16.

Office Action for U.S. Appl. No. 29/635,169 dated Mar. 26, 2018.

Collette, et al, "Associated Food Trapezoid Merchandising Test", Exhibit R in Case No. 17-cv-04915-JNE-TNL, Apr. 2015, 3 pages.

Complaint, Case No. 17-cv-04915-JNE-SER, dated Sep. 26, 2017, pp. 1-20.

Declaration of Jesse R. Garcia (with exhibits), Case No. 17-cv-04915-JNE-SER, dated Sep. 27, 2017, pp. 1-148.

Declaration of Ronald Kemnitzer (with exhibits), Case No. 17-cv-04915-JNE-SER, dated Sep. 27, 2017, pp. 1-379.

Defendants' Amended Answer, Separate Defenses, and Counterclaims to Plaintiff's Complaint for Patent Infringement, Case No. 17-cv-04915-JNE-TNL, dated Apr. 13, 2018, pp. 1-14.

Defendants' Answer, Separate Defenses, and Counterclaims to Plaintiff's Complaint for Patent Infringement, Case No. 17-cv-04915-JNE-TNL, dated Nov. 11, 2017, pp. 1-14.

Expert Report of Paul Hatch, Exhibit A in Case No. 17-cv-04915-JNE-TNL, dated Nov. 11, 2017, pp. 1-133.

First Amended Complaint, Case No. 17-cv-04915-JNE-TNL, dated Mar. 30, 2018, pp. 1-24.

Hearing on Post's Motion for Preliminary Injunction, Powerpoint Presentation Final, Case No. 17-cv-04918, dated Dec. 1, 2017, pp. 1-34.

Hearing on Post's Motion for Preliminary Injunction, Powerpoint Presentation, Case No. 17-cv-04918, dated Dec. 1, 2017, pp. 1-43.

Memorandum in Support of Plaintiffs Motion for Preliminary Injunction, Case No. 17-cv-04915-JNE-SER, dated Sep. 27, 2017, pp. 1-43.

Plaintiff Post Consumer Brands, LLC's Answer to Defendants Amended Counterclaims, Case No. 17-cv-04915-JNE-TNL, dated Apr. 27, 2018, pp. 1-5.

Post's Reply in Support of Its Motion for Preliminary Injunction, Case No. 17-cv-04915-JNE-TNL, dated Nov. 27, 2017, pp. 1-38.

Supplemental Expert Report of Paul Hatch, Case No. 17-cv-04915-JNE-TNL, dated Nov. 30, 2017, pp. 1-14.

Transcript of Preliminary Injunction Hearing, Case No. 17-cv-04915-JNE-TNL, dated Dec. 1, 2017, pp. 1-53.

Transcript of Video Deposition of General Mills, Inc., Genral Mills Sales, Inc., and Paul D. Hatch Exhibit PP in Case No. 17-cv-04915-JNE-TNL, Nov. 22, 2017, 211 pages.

Transcript of Videotaped Deposition of Ronald Kemnitzer, Exhibit GG in Case No. 17-cv-04915-JNE-TNL, Nov. 14, 2017, 124 pages.

* cited by examiner

METHOD OF USING SHELF DIVIDER SYSTEM

CROSS-REFERENCE TO RELATED APPLICATIONS

This application is a continuation of U.S. Ser. No. 15/146,349, filed May 4, 2016, currently pending the disclosure of which is incorporated by reference herein.

FIELD OF THE DISCLOSURE

The disclosure pertains generally to shelf partitions for displaying bagged food items. More particularly, the disclosure pertains to an L-shaped adjustable shelf partition that also serves as an advertisement fixture.

GENERAL BACKGROUND

It is becoming increasing common to package and sell particular bulk food items in plastic bags. For example, many breakfast cereals are now sold in bags rather than boxes. Other bulk food items are also sold in bags (e.g., rice). It should be appreciated that such bags of packaged food products are pliable and deformable, albeit they maintain substantial constant volume. In general, it is impractical to arrange bagged food items on a point-of-sale shelf in a manner such that particular printing on the bags face store patrons. Thus, it can be difficult for patrons to quickly discern what brand of product is provided in the bags. It is therefore common to mount partitions/dividers on shelves to separate and isolate different brands and/or sizes of bagged food items in partitioned compartments and to put other signage near each partitioned compartment for the purpose of identifying and advertisement the bagged food items. In some cases, such signage is attached to or provided on the partitions themselves. The disclosure that follows improves upon known prior art shelf partitions for bags of bulk food.

Figure 1:
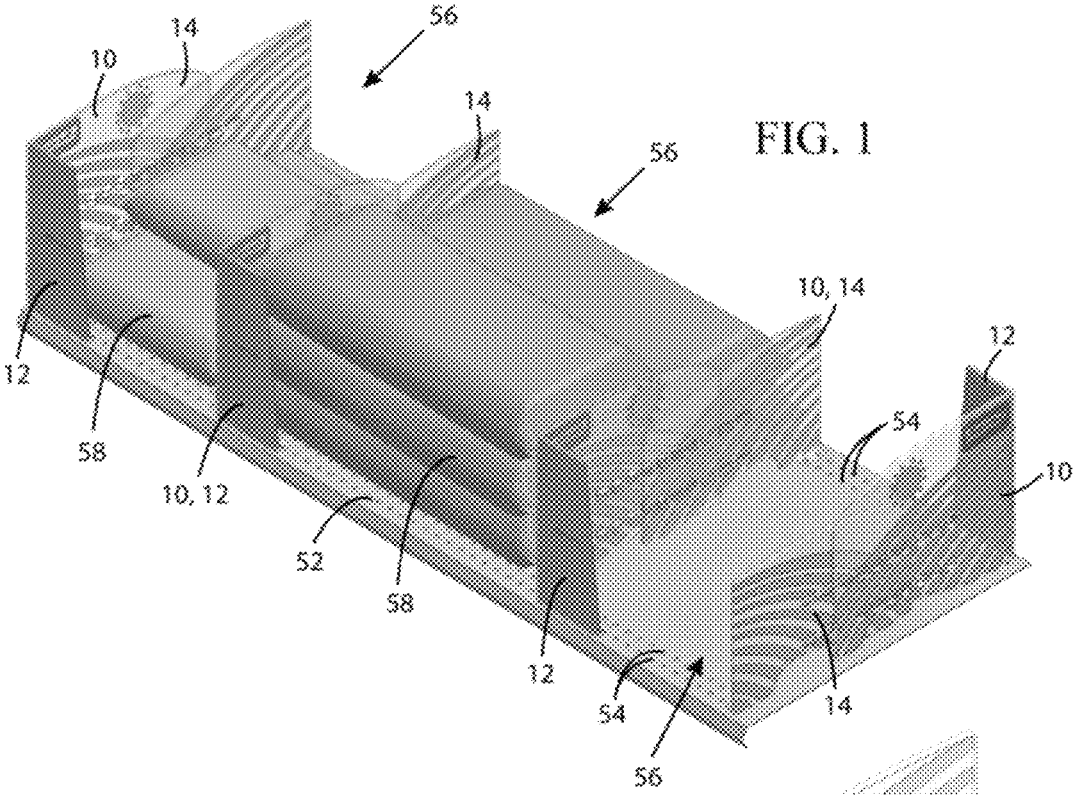
FIG. 1 depicts a perspective view of a plurality of exemplary shelf partitions attached to a point-of-sale shelf with bagged bulk food packages placed on the self therebetween.

Reference numerals in the written specification and in the drawing figures indicate corresponding items.

DETAILED DESCRIPTION

Figure 2:
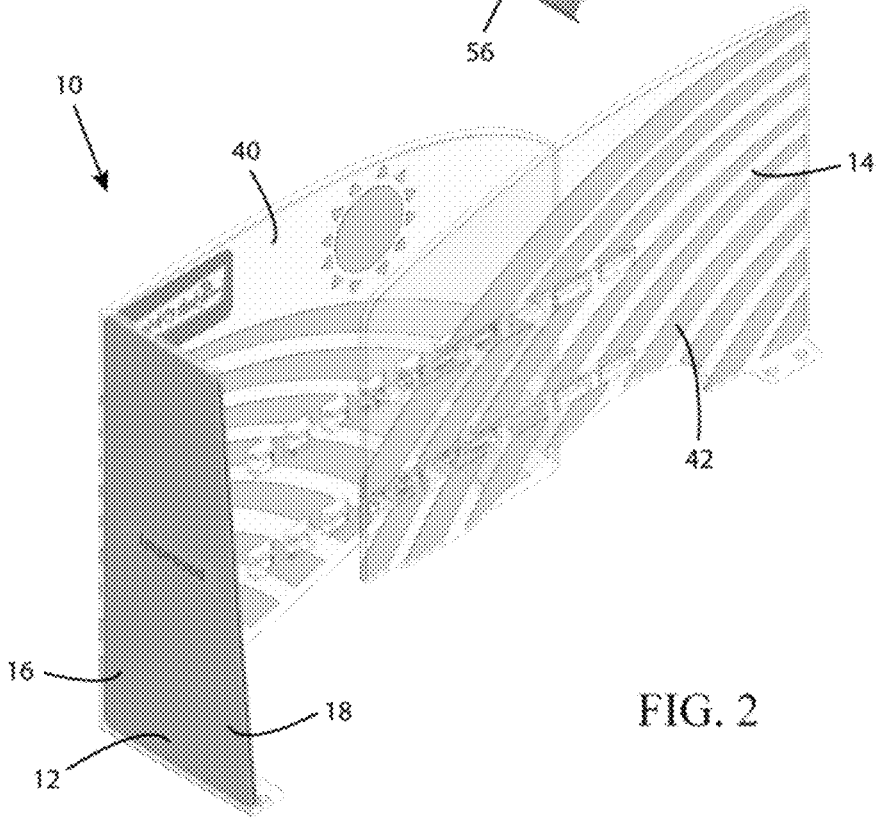
FIG. 2 depicts a perspective view of one of the shelf partitions, with the side panel of the shelf partition in an extended configuration.
Figure 3:
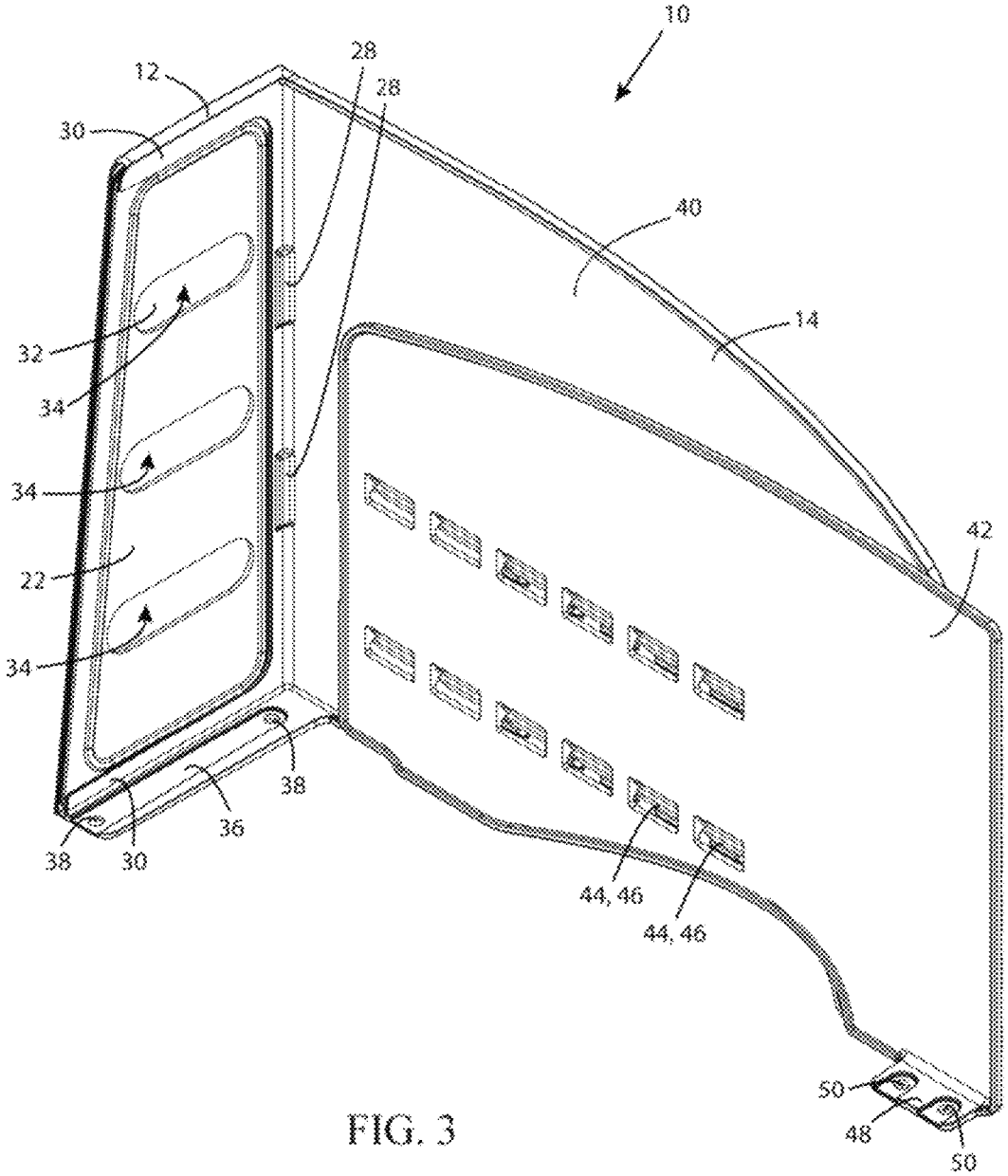
FIG. 3 depicts another perspective view of one of the shelf partitions, with the side panel of the shelf partition in an un-extended configuration.
Figure 4:
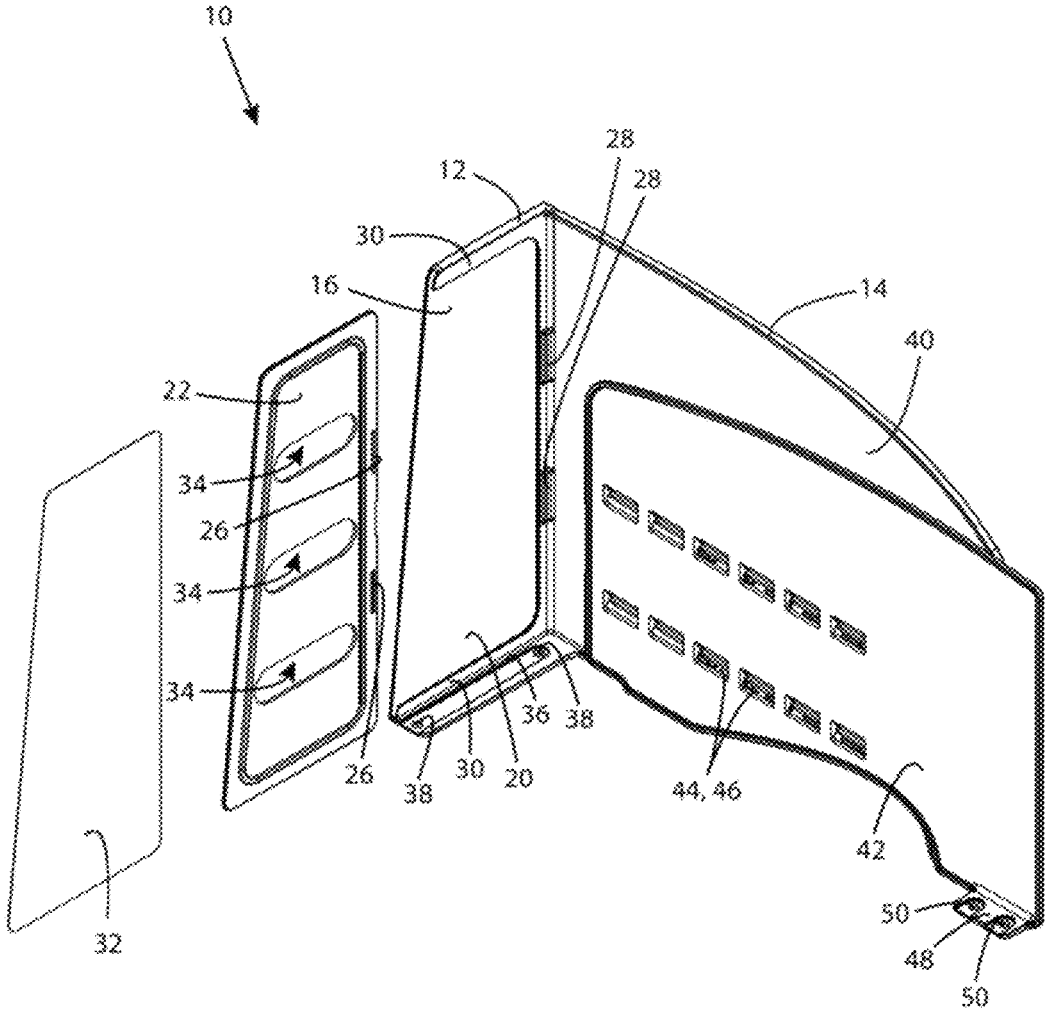
FIG. 4 depicts an exploded perspective view of the shelf partition as shown in FIG. 3, except with the support wall of its front panel and product advertisement shown detached from the shelf partition.
Figure 5:
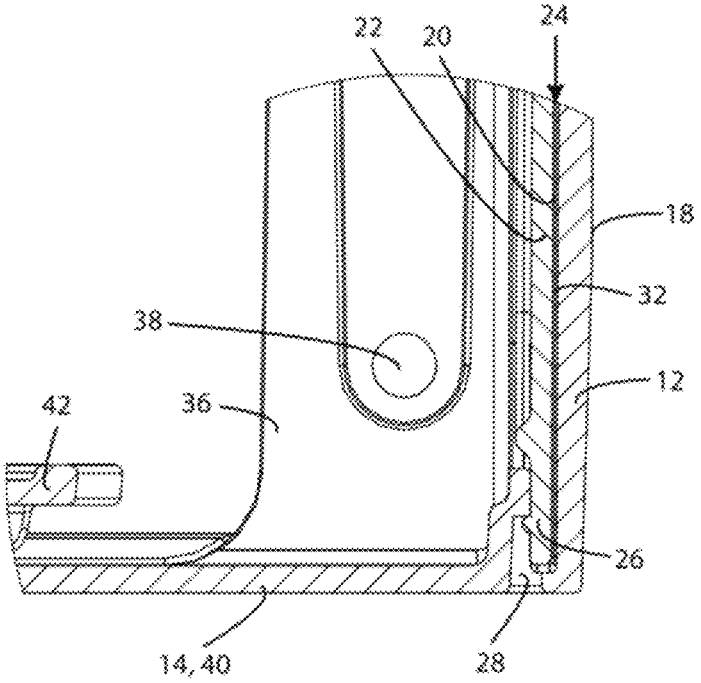
FIG. 5 depicts a detail horizontal cross-section of the shelf partition taken about a horizontal plane that intersects one of the locking formations of the support wall of the shelf partition.
Figure 6:
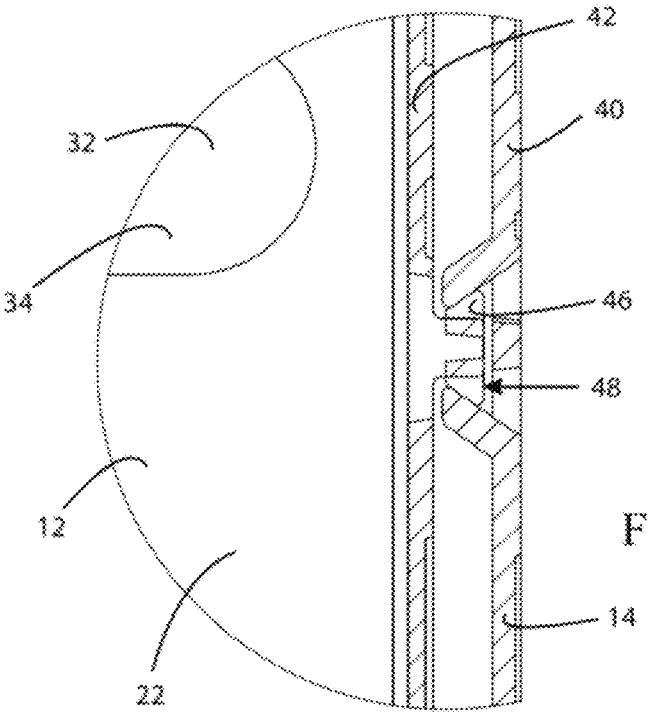
FIG. 6 depicts a detail vertical cross-section of the side panel of the shelf partition showing one set of the interlocking formations between the first and second portions of the side panel.

An exemplary embodiment of a shelf partition (10) for separating and displaying bagged bulk food on point-of-sale shelving is shown in FIGS. 2-4. The shelf partition (10) comprises a front panel (12) and an adjustable length side panel (14). The front panel (12) and the side panel (14) are connected to each other in a manner such that the shelf partition (10) is L-shaped in plan view (i.e., when viewed from directly above).

The front panel (12) comprises a translucent (and preferably transparent) front portion (16) that has a slightly convex outer surface (18). The back (20) of the front portion (16) is preferably flat. As such, the front portion (16) of the front panel (12) is configured to magnify what is behind the front portion of the front panel. The front panel (12) also comprises a support wall member (22) that that is spaced behind the front portion (16) of the front panel in a manner forming a pocket (24) between the front portion and the support wall member. The support wall member (22) is preferably formed separate from the remainder of the front panel (12) but is preferably configured to interlock with the remainder of the front panel via tabs (26) and slots (28). Once secured to the remainder of the front panel (12) via the tabs (26) and slots (28), the support wall member (22) is held generally parallel to the front portion (12) of the front panel by rails (30) that extend horizontally along the top and bottom of the front portion. The pocket (24) between the front portion (16) and the support wall member (22) of the front panel (12) is open along its rightmost end. As such, an advertisement member (32) can be slid into the pocket (24) where it will visible through the translucent front portion (16) of the front panel (12). The advertisement member (32) may be printed paper, cardboard, or any sheet material. The front portion (16) and support wall member (22) of the front panel (12), and the advertisement member (32) preferably all have generally the same perimeter shape and size. Preferably that perimeter shape is trapezoidal as shown, with horizontal top and bottom edges, a vertical left edge, and a sloped right edge. The support wall member (22) also preferably comprises at least one opening (34) that provides a finger hole to facilitate the removal of the advertisement member (32) from the pocket (24) of the front panel (12). The primary purpose of the of the support wall member (22) is to hold the advertisement member (32) against the front portion (16) of the front panel (12) and to prevent inadvertant removal of the advertisement member from the shelf partition (10) when bagged bulk food packages slide against the back of the front panel. The base of the front panel (12) also preferably comprises a support foot (36) that has a plurality of through-holes (38) that are configured to receive fasteners (not shown) for securing the shelf partition (10) to a point-of-sale shelf, as is explained in greater detail below.

The side panel (14) of the shelf partition (10) preferably comprises first (40) and second (42) portions that are slideably connected to each other in a manner allowing the length (depth) of the side panel to be adjusted prior to attaching the shelf partition to a point-of-sale shelf. The first portion (40) of the side panel (14) is preferably formed integrally with the front portion (16) of the front panel (12) as a monolithic and homogenous injection molded piece of polycarbonate. The second portion (42) of the side panel (14) is preferably interlocked to the first portion (40) of the side panel via a plurality of slots (44) and tabs (46) that prevent relative movement between the first and second portions, except for horizontal relative movent parallel to the length of the side panel. Thus, prior to being fully attached to a shelf, the length/depth of the side panel (14) can be adjusted to match the depth of the shelf. The base of the second portion (42) of the side panel also preferably comprises a support foot (48) having a plurality of through-holes (50) configured to receive fasteners (not shown) for securing the shelf partition (10) to a point-of-sale shelf. As shown in FIGS. 1 and 2, the first (40) and second (42) portions of the side panel (14), preferably have perimeters and textured surfaces that themselves may resemble the trademark(s) associated with the bagged bulk food the shelf partition (10) is configured to separate and display.

In use, shelf partitions (10) configured as described above are attached to a point-of-sale shelf (52) as shown in FIG. 1. This is done be inserting press fittings through the through-holes (38, 50) of the support feet (36, 48) of the front and side panels and into the standard holes (54) typically provided on such a point-of-sale shelf (52). The adjustability of the length of the side panel (14) of each shelf partition (10) allows the shelf partition to be set to the depth of the shelve (52) (which is typically somewhere from fourteen to twenty eight inches). As shown in FIG. 1, the front panels (12) of the shelf partitions (10) are typically oriented facing the side of the shelf that faces a store aisle. However, in situations where it is desired to store/display bagged products adjacent to a right side edge of a shelf (52), the right-most shelf partition (10) can be reversed (i.e., attached to the shelf with the front panel (12) of said shelf partition adjacent the rear of the shelf) such that the side panel (14) of the shelf partition can be in close proximity to the right edge of the shelf (as shown in FIG. 1). As is shown in FIG. 1, the shelf partitions (10) can thereby form partitioned compartments (56) for storing and displaying bags (58) of bulk food or other bagged bulk items. Preferable the shelf partitions (10) are spaced from each other along the shelf (52) in a manner such that bags (58) of bulk food or other items fit snugly between the shelf partitions. As such, the front panels (12) of the shelf partitions (10) help prevent such bags (58) from inadvertently siding off of the shelf (52). When replacing one type of bagged food products (58) with another, the spacing between the shelf partitions (10) can be adjusted (if needed) any relevant advertisement member (32) can easily and quickly be replaced by sliding the advertisement member out of the pocket (24) of the front panel (12).

Although various modifications could be made in the constructions and methods described and illustrated herein, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent or explicit.

What is claimed is:

1. A method of displaying bagged bulk food items on a point-of-sale shelf comprising the steps of:

providing first and second shelf partitions, wherein each of the shelf partitions has a front panel and an adjustable length side panel, the front panel has a first lateral edge and a second lateral edge, the front panel second lateral edge being spaced from the front panel first lateral edge by at least a first distance, the adjustable length side panel has first and second portions, the second portion is slidably connected with the first portion to adjust a length of the adjustable length side panel between an expanded position in which the second portion overlaps some of the first portion and a retracted position in which the second portion overlaps more of the first portion while restraining the first portion and the second portion from moving vertically relative to each other, the adjustable length side panel first portion has opposite forward and rearward edges, the adjustable length side panel first portion forward edge is connected to the front panel adjacent to the first lateral edge of the front panel so that the first portion and the front panel together form an L-shape, the adjustable length side panel second portion defines a plane perpendicular to the front panel and has opposite forward and rearward edges that are devoid of any projections therefrom that extend at least the first distance, the adjustable length side panel second portion forward edge is closer to the front panel than the adjustable length side panel second portion rearward edge, the adjustable length side panel first portion has a top peripheral edge extending from the adjustable length side panel first portion forward edge to the adjustable length side panel first portion rearward edge, the adjustable length side panel first portion top peripheral edge has a region tapering toward the adjustable length side panel first portion rearward edge in a manner such that the adjustable length side panel first portion forward edge is longer than the adjustable length side panel first portion rearward edge, the adjustable length side panel second portion has a top peripheral edge extending from the adjustable length side panel second portion forward edge to the adjustable length side panel second portion rearward edge, the adjustable length side panel second portion top peripheral edge has a region tapering toward the adjustable length side panel second portion forward edge in a manner such that the adjustable length side panel second portion forward edge is shorter than the adjustable length side panel second portion rearward edge;

attaching the first shelf partition to the point-of-sale shelf in a manner such that the front panel of the first shelf partition is adjacent to an aisle facing side of the point-of-sale shelf and the adjustable length side panel second portion rearward edge of the first shelf partition is adjacent to a rear side of the point-of-sale shelf opposite of the aisle facing side of the point-of-sale shelf; and attaching the second shelf partition to the point-of-sale shelf in a manner such that the front panel of the second shelf partition is adjacent to the rear side of the point-of-sale shelf and the adjustable length side panel second portion rearward edge of the second shelf partition is adjacent to the aisle facing side of the point-of-sale shelf, and the second shelf partition is spaced from the first shelf partition a distance along the point-of-sale shelf sufficient to accommodate placing the bagged bulk food items on the point-of-sale shelf between the adjustable length side panels of the first and second shelf partitions and partially behind the front panel of the first shelf partition.

2. The method of claim 1 further comprising the steps of: placing the bagged bulk food items on the point-of-sale shelf between the adjustable length side panels of the first and second shelf partitions and partially behind the front panel of the first shelf partition.

3. The method of claim 1 wherein the front panel of the first shelf partition comprises a pocket and the method further comprises the step of placing an advertisement in the pocket of the front panel of the first shelf partition.

4. The method of claim 1 further comprising the steps of:

providing a third shelf partition, wherein the third shelf partition has a front panel and an adjustable length side panel, the third shelf partition front panel has opposite first and second lateral edges, the third shelf partition adjustable length side panel has first and second portions, the second portion of the third shelf partition adjustable length side panel is slidably connected with the first portion of the third shelf partition adjustable length side panel to adjust a length of the third shelf partition adjustable length side panel between an expanded position in which the second portion of the third shelf partition adjustable length side panel overlaps some of the first portion of the third shelf partition adjustable length side panel and a retracted position in which the second portion of the third shelf partition adjustable length side panel overlaps more of the first portion of the third shelf partition adjustable length side panel, the first portion of the third shelf partition adjustable length side panel has opposite forward and rearward edges, the first portion forward edge of the third shelf partition adjustable length side panel is connected to the third shelf partition front panel adjacent to the first lateral edge of the third shelf partition front panel so that the first portion of the third shelf partition adjustable length side panel and the third shelf partition front panel together form an L-shape, the second portion of the third shelf partition adjustable length side panel has opposite forward and rearward edges, the second portion forward edge of the third shelf partition adjustable length side panel is closer to the third shelf partition front panel than the second portion rearward edge of the third shelf partition adjustable length side panel, the first portion of the third shelf partition adjustable length side panel has a top peripheral edge extending from the first portion forward edge of the third shelf partition adjustable length side panel to the first portion rearward edge of the third shelf partition adjustable length side panel, the first portion top peripheral edge of the third shelf partition adjustable length side panel has a region tapering toward the first portion rearward edge of the third shelf partition adjustable length side panel in a manner such that the first portion forward edge of the third shelf partition adjustable length side panel is longer than the first portion rearward edge of the third shelf partition adjustable length side panel, the second portion of the third shelf partition adjustable length side panel has a top peripheral edge extending from the second portion forward edge of the third shelf partition adjustable length side panel to the second portion rearward edge of the third shelf partition adjustable length side panel, the second portion top peripheral edge of the third shelf partition adjustable length side panel has a region tapering toward the second portion forward edge of the third shelf partition adjustable length side panel in a manner such that the second portion forward edge of the third shelf partition adjustable length side panel is shorter than the second portion rearward edge of the third shelf partition adjustable length side panel; and attaching the third shelf partition to the point-of-sale shelf in a manner such that the third shelf partition front panel is adjacent to the aisle facing side of the point-of-sale shelf and the third shelf partition adjustable length side panel second portion rearward edge is adjacent to the rear side of the point-of-sale shelf opposite of the aisle facing side of the point-of-sale shelf, and the third shelf partition is spaced from the first shelf partition a distance along the point-of-sale shelf sufficient to accommodate placing additional bagged bulk food items on the point-of-sale shelf between the adjustable length side panels of the first and third shelf partitions and partially behind the third shelf partition front panel of the third shelf partition.

5. The method of claim 4 further comprising the steps of: placing the additional bagged bulk food items on the point-of-sale shelf between the adjustable length side panels of the first and third shelf partitions and partially behind the third shelf partition front panel of the third shelf partition.

6. A method of displaying bagged bulk food items on a point-of-sale shelf comprising the steps of:

providing first and second shelf partitions, wherein each of the shelf partitions has a transparent front panel and an adjustable length side panel with first and second portions, the front panel has a pocket open on at least one side, the pocket is configured to removably receive a product advertisement, the front panel has a first lateral edge and a second lateral edge, the front panel second lateral edge being spaced from the front panel first lateral edge by at least a first distance, the front panel has a first mounting foot projecting rearwardly from a bottom of the front panel, the first mounting foot is configured to receive a fastener for securing the partition to the point-of-sale shelf, the adjustable length side panel second portion is slidably connected with the adjustable length side panel first portion to adjust a length of the adjustable length side panel between an expanded position in which the second portion overlaps some of the first portion and a retracted position in which the second portion overlaps more of the first portion while restraining the first portion and the second portion from moving vertically relative to each other, the first portion has opposite forward and rearward edges, the first portion forward edge is longer than the first portion rearward edge, the first portion forward edge projects rearwardly from the front panel adjacent to the first lateral edge of the front panel so that the first portion and the front panel together form an L-shape, the second portion defines a plane perpendicular to the front panel and has opposite forward and rearward edges that are devoid of any projections therefrom that extend at least the first distance, the adjustable length side panel second portion forward edge is shorter than the second portion rearward edge, the adjustable length side panel second portion has a second mounting foot extending laterally from a bottom of the second portion adjacent the rearward edge of the second portion, the second mounting foot is configured to receive a fastener for securing each shelf partition to the point-of-sale shelf, the first portion has a top peripheral edge, the first portion top peripheral edge has a region sloping downward away from the front panel, the second portion has a top peripheral edge, the second portion top peripheral edge has a region sloping downward toward the front panel, the adjustable length side panel has a textured surface including at least a trademark associated with the bagged bulk food items;

attaching the first shelf partition to the point-of-sale shelf in a manner such that the front panel of the first shelf partition is adjacent to an aisle facing side of the point-of-sale shelf and the adjustable length side panel second portion rearward edge of the first shelf partition is adjacent to a rear side of the point-of-sale shelf opposite of the aisle facing side of the point-of-sale shelf; and attaching the second shelf partition to the point-of-sale shelf in a manner such that the front panel of the second shelf partition is adjacent to the rear side of the point-of-sale shelf and the adjustable length side panel second portion rearward edge of the second shelf partition is adjacent to the aisle facing side of the point-of-sale shelf, and the second shelf partition is spaced from the first shelf partition a distance along the point-of-sale shelf sufficient to accommodate placing the bagged bulk food items on the point-of-sale shelf between the adjustable length side panels of the first and second shelf partitions and partially behind the front panel of the first shelf partition.

7. The method of claim 6 further comprising the steps of: placing the bagged bulk food items on the point-of-sale shelf between the adjustable length side panels of the first and second shelf partitions and partially behind the front panel of the first shelf partition.

8. The method of claim 6 further comprising the step of: placing the product advertisement in the pocket of the front panel of the first shelf partition.

9. The method of claim 6 further comprising the step of: for at least one of the first and second shelf partitions, moving the adjustable length side panel second portion relative to the adjustable length side panel first portion between the retracted position and the expanded position in accordance with a distance between the rear side of the point-of-sale shelf and the aisle facing side of the point-of-sale shelf.

10. The method of claim 6 further comprising the steps of:

providing a third shelf partition, wherein the third shelf partition has a transparent front panel and an adjustable length side panel with first and second portions, the third shelf partition front panel has opposite first and second lateral edges, the third shelf partition front panel has a pocket open on at least one side, the third shelf partition pocket is configured to removably receive a product advertisement, the third shelf partition front panel has a first mounting foot projecting rearwardly from a bottom of the third shelf partition front panel, the third shelf partition first mounting foot is configured to receive a fastener for securing the third shelf partition to the point-of-sale shelf, the second portion of the third shelf partition adjustable length side panel is slidably connected with the first portion of the third shelf partition adjustable length side panel to adjust a length of the third shelf partition adjustable side panel between an expanded position in which the second portion of the third shelf partition adjustable length side panel overlaps some of the first portion of the third shelf partition adjustable length side panel and a retracted position in which the second portion of the third shelf partition adjustable length side panel overlaps more of the first portion of the third shelf partition adjustable length side panel while restraining the first portion of the third shelf partition and the second portion of the third shelf partition from moving vertically relative to each other, the first portion of the third shelf partition adjustable length side panel has opposite forward and rearward edges, the first portion forward edge of the third shelf partition adjustable length side panel is longer than the first portion rearward edge of the third shelf partition adjustable length side panel, the first portion forward edge of the third shelf partition adjustable length side panel is connected to the third shelf partition front panel adjacent to the first lateral edge of the third shelf partition front panel so that the first portion of the third shelf partition adjustable length side panel and the third shelf partition front panel together form an L-shape, the second portion of the third shelf partition adjustable length side panel has opposite forward and rearward edges, the second portion forward edge of the third shelf partition adjustable length side panel is shorter than the second portion rearward edge of the third shelf partition adjustable length side panel, the second portion of the third shelf partition adjustable length side panel has a second mounting foot extending laterally from a bottom of the second portion of the third adjustable length side panel adjacent to the rearward edge of the second portion of the third shelf partition adjustable length side panel, the second mounting foot is configured to receive a fastener for securing the third shelf partition to the point-of-sale shelf, the first portion of the third shelf partition adjustable length side panel has a top peripheral edge, the first portion top peripheral edge of the third shelf partition adjustable length side panel has a region sloping downward away from the third shelf partition front panel, the second portion of the third shelf partition adjustable length side panel has a top peripheral edge, the second portion top peripheral edge of the third shelf partition adjustable length side panel has a region sloping downward toward the third shelf partition front panel, the third shelf partition adjustable side panel has a textured surface including at least a trademark associated with the bagged bulk food items;

attaching the third shelf partition to the point-of-sale shelf in a manner such that the third shelf partition front panel is adjacent to the aisle facing side of the point-of-sale shelf and the second portion rearward edge of the third shelf partition adjustable length side panel is adjacent to the rear side of the point-of-sale shelf opposite of the aisle facing side of the point-of-sale shelf, and the third shelf partition is spaced from the first shelf partition a distance along the point-of-sale shelf sufficient to accommodate placing additional bagged bulk food items on the point-of-sale shelf between the adjustable length side panels of the first and third shelf partitions and partially behind the third shelf partition front panel of the third shelf partition.

11. The method of claim 10 further comprising the steps of: placing the additional bagged bulk food items on the point-of-sale shelf between the adjustable length side panels of the first and third shelf partitions and partially behind the third shelf partition front panel of the third shelf partition.

12. The method of claim 10 further comprising the step of: placing the product advertisement in the pocket of the third shelf partition front panel of the third shelf partition.

13. The method of claim 10 further comprising the steps of:

moving the second portion of the third adjustable side panel relative to the first portion of the third adjustable side panel between the retracted position and the expanded position in accordance with a distance between the rear side of the point-of-sale shelf and the aisle facing side of the point-of-sale shelf.

14. A method of displaying bagged bulk food items on a point-of-sale shelf comprising the steps of:

providing first and second shelf partitions, wherein each of the shelf partitions has a front panel and an adjustable length side panel, the front panel has a first lateral edge and a second lateral edge, the front panel second lateral edge being spaced from the front panel first lateral edge by at least a first distance, the adjustable length side panel has first and second portions, the second portion is slidably connected with the first portion to adjust a length of the adjustable length side panel between an expanded position in which the second portion overlaps some of the first portion and a retracted position in which the second portion overlaps more of the first portion while restraining the first portion and the second portion from moving vertically relative to each other, the adjustable length side panel first portion has opposite forward and rearward edges, the adjustable length side panel first portion forward edge is connected to the front panel adjacent to the first lateral edge of the front panel so that the first portion and the front panel together form an L-shape, the adjustable length side panel second portion defines a plane perpendicular to the front panel and has opposite forward and rearward edges that are devoid of any projections therefrom that extend at least the first distance, the adjustable length side panel second portion forward edge is closer to the front panel than the adjustable length side panel second portion rearward edge, the adjustable length side panel first portion has a top peripheral edge extending from the adjustable length side panel first portion forward edge to the adjustable length side panel first portion rearward edge, the adjustable length side panel first portion top peripheral edge has a region tapering toward the adjustable length side panel first portion rearward edge in a manner such that the adjustable length side panel first portion forward edge is longer than the adjustable length side panel first portion rearward edge, the adjustable length side panel second portion has a top peripheral edge extending from the adjustable length side panel second portion forward edge to the adjustable length side panel second portion rearward edge, the adjustable length side panel second portion top peripheral edge has a region tapering toward the adjustable length side panel second portion forward edge in a manner such that the adjustable length side panel second portion forward edge is shorter than the adjustable length side panel second portion rearward edge;

attaching the first shelf partition to the point-of-sale shelf in a manner such that the front panel of the first shelf partition is adjacent to an aisle facing side of the point-of-sale shelf and the adjustable length side panel second portion rearward edge of the first shelf partition is adjacent to a rear side of the point-of-sale shelf opposite of the aisle facing side of the point-of-sale shelf; and attaching the second shelf partition to the point-of-sale shelf in a manner such that the front panel of the second shelf partition is adjacent to the aisle facing side of the point-of-sale shelf and the adjustable length side panel second portion rearward edge of the second shelf partition is adjacent to the rear side of the point-of-sale shelf, and the second shelf partition is spaced from the first shelf partition a distance along the point-of-sale shelf sufficient to accommodate placing the bagged bulk food items on the point-of-sale shelf between the adjustable length side panels of the first and second shelf partitions and partially behind the front panel of the first shelf partition.

* * * * *